US006349902B1

(12) United States Patent
Cripe

(10) Patent No.: US 6,349,902 B1
(45) Date of Patent: Feb. 26, 2002

(54) WIND SOCK WITH DIHEDRAL WINGS

(76) Inventor: Jeffrey Ray Cripe, 4207 E. 2nd Ave., Spokane, WA (US) 99202

( * ) Notice: Subject to any disclaimer, the term of this patent is extended or adjusted under 35 U.S.C. 154(b) by 0 days.

(21) Appl. No.: 09/754,925

(22) Filed: Jan. 3, 2001

(51) Int. Cl.[7] ..... A63H 27/08; B64C 31/06

(52) U.S. Cl. ..... 244/153 R; 43/2; 43/3; 446/61

(58) Field of Search ..... 244/153 R, 1 R; 446/61; 43/2, 3

(56) References Cited

U.S. PATENT DOCUMENTS

| | | | | | |
|---|---|---|---|---|---|
| 72,855 | A | | 12/1867 | Hughes | 244/153 R |
| 1,299,465 | A | | 4/1919 | Henley | 244/153 R |
| D57,448 | S | | 3/1921 | Shrun | 244/153 R |
| 1,378,193 | A | | 5/1921 | Petty | 244/153 R |
| 2,349,417 | A | | 5/1944 | Gene | 244/153 R |
| 2,507,777 | A | | 5/1950 | Frey | 244/153 R |
| 3,076,626 | A | | 2/1963 | Andrews | 244/153 R |
| D196,057 | S | | 8/1963 | Levine | 244/153 R |
| D196,849 | S | | 11/1963 | Koonce | 244/153 R |
| 3,110,460 | A | | 11/1963 | Koonce et al. | 244/153 R |
| 3,540,149 | A | | 11/1970 | Lowe | 244/153 R |
| 3,787,998 | A | | 1/1974 | Kilroy, Jr. et al. | 244/153 R |
| 4,228,977 | A | | 10/1980 | Tanaka | 244/153 R |
| 4,911,384 | A | | 3/1990 | Stankus | 244/153 R |
| 5,144,764 | A | * | 9/1992 | Peterson | 43/3 |
| 5,524,851 | A | * | 6/1996 | Huang | 244/153 R |
| 6,050,017 | A | * | 4/2000 | Barry | 43/2 |
| 6,095,458 | A | * | 8/2000 | Cripe | 244/153 R |

FOREIGN PATENT DOCUMENTS

| | | |
|---|---|---|
| DE | 511627 | 11/1930 |

* cited by examiner

*Primary Examiner*—J. Woodrow Eldred
(74) *Attorney, Agent, or Firm*—Wells, St. John, Roberts, Gregory & Matkin

(57) ABSTRACT

A windsock includes an elongated fuselage with outwardly extending dihedral wings. A dihedral spar extends along the wings and is joined with a coupling that is movably positioned within the fuselage cavity. A stabilizer is also mounted to the coupling and is movable within the fuselage through a limited range of motion.

20 Claims, 6 Drawing Sheets

WIND SOCK WITH DIHEDRAL WINGS

TECHNICAL FIELD

The present invention relates to wind socks, and more particularly to wind socks with dihedral wings.

BACKGROUND OF THE INVENTION

Wind socks have been produced in the past in bird shapes with outstretched wings that have been used to give an more lifelike look to the windsock, and for aerodynamic purposes to lift the windsock in a manner similar to a kite.

U.S. Pat. No. 4,911,384 to Stankus discloses a winged kite. The kite includes an elongated body that is attached to the bottom side of a flat sheet lift member that forms right and left wings and a tail. An elongated flexible spar extends across the top of the wings and is anchored at opposite ends to the outward wing ends. Left and right leading edges of the wing are curled upwardly and over the spar for the stated purpose of providing stability and causing wing movement.

U.S. Pat. No. 6,095,458 also discloses a winged kite. This kite achieves wing movement during flight through provision of a spar and winged configuration.

While the above kites are serviceable, the need remains for yet further stability in the winged devices.

There is also a need, especially when the kites or windsocks are used as decoys, for the wings to function in a manner at least somewhat similar to that of a live, flying animal.

The above needs and others are intended to be fulfilled by provision of the present invention as described below.

BRIEF DESCRIPTION OF THE DRAWINGS

Preferred embodiments of the invention are described below with reference to the following accompanying drawings.

FIG. 7 is an exploded perspective view of the spar, coupling and stabilizer.

DESCRIPTION OF THE PREFERRED EMBODIMENTS

Figure 1:
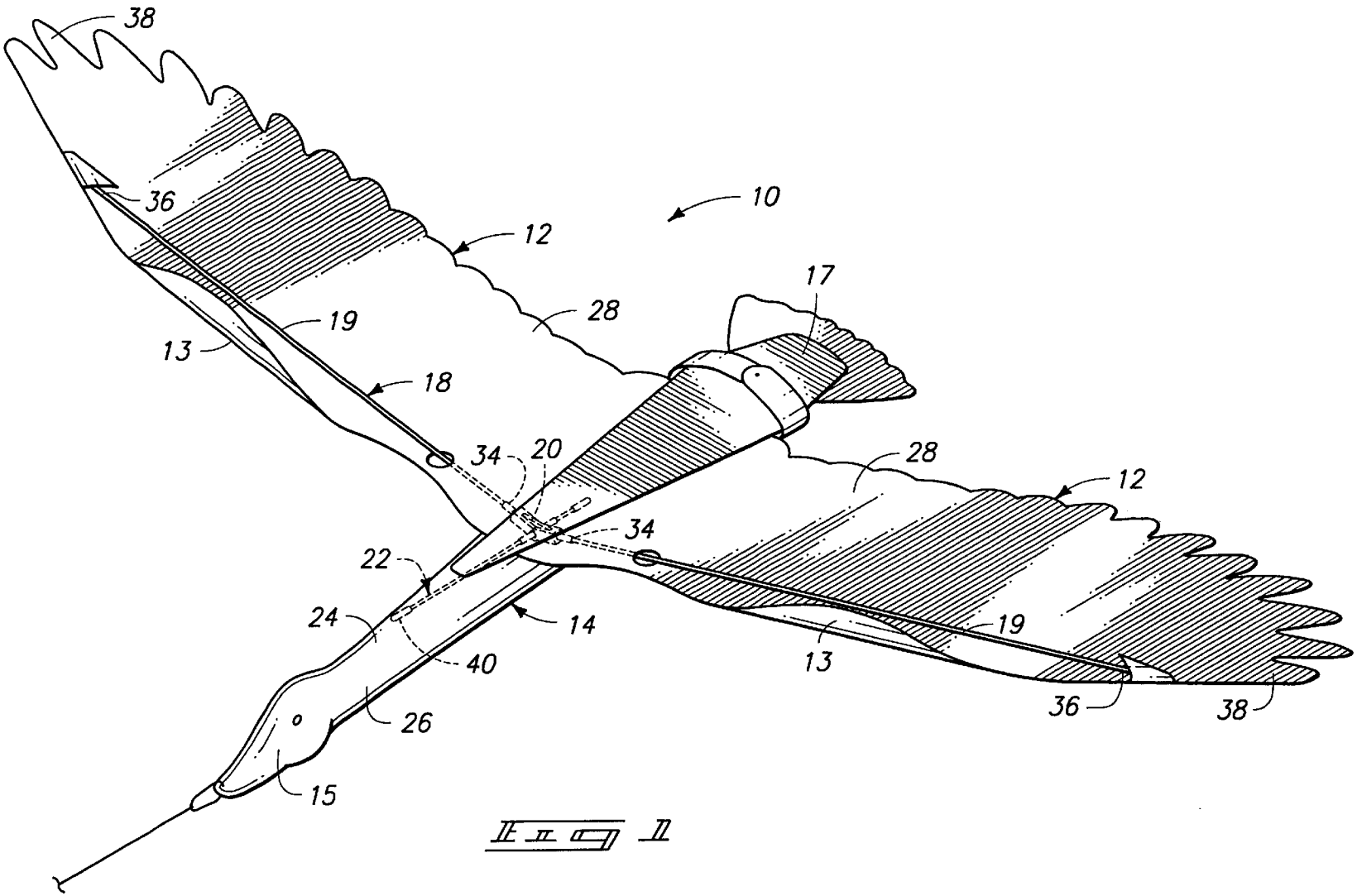
FIG. 1 is a perspective view of a wind sock incorporating elements of a preferred form of my invention.
Figure 2:
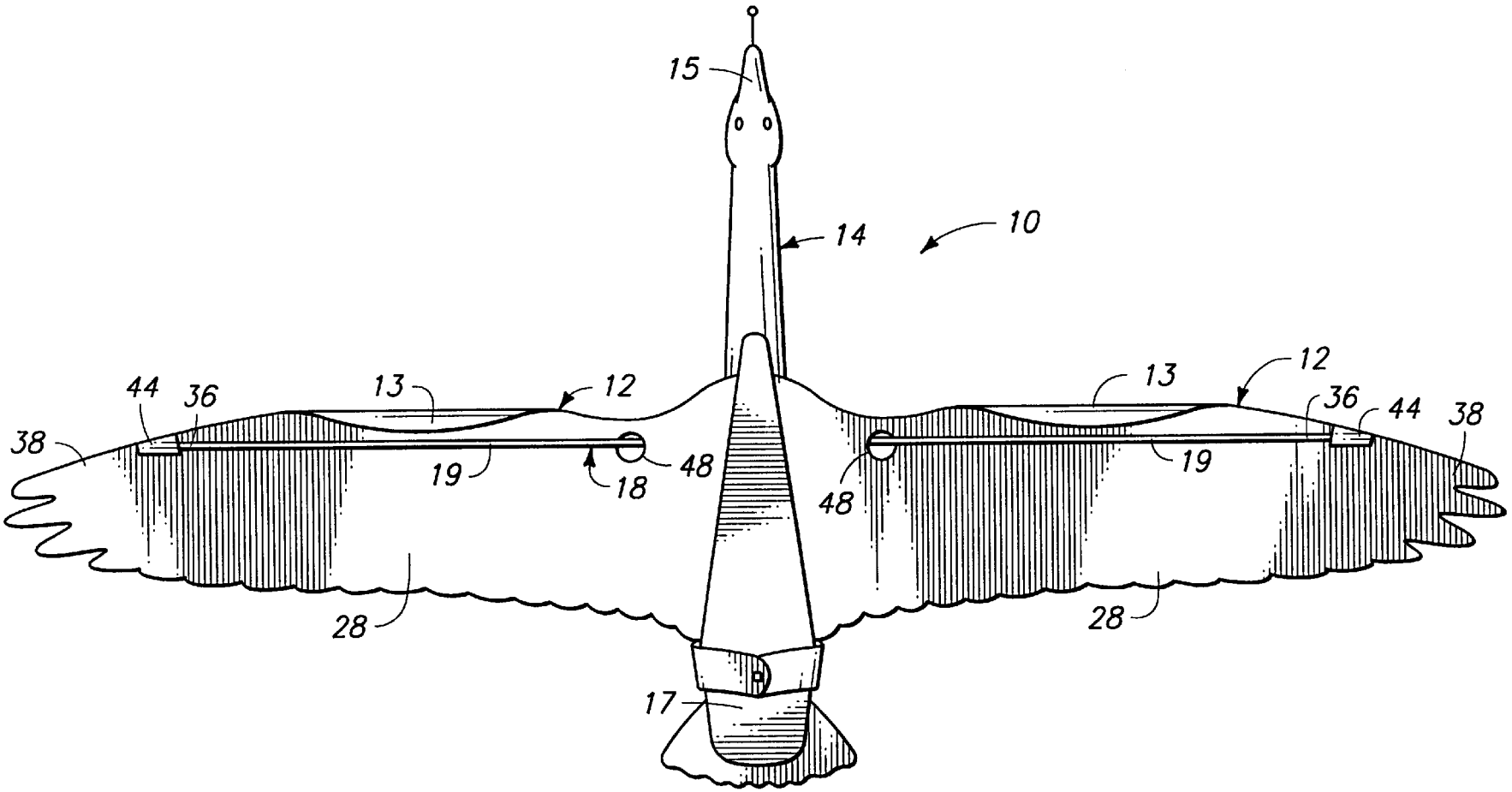
FIG. 2 is a top plan view thereof.

This disclosure of the invention is submitted in furtherance of the constitutional purposes of the U.S. Patent Laws "to promote the progress of science and useful arts" (Article 1, Section 8).

GENERAL ASPECTS

In a first aspect of the invention, a windsock 10 includes wings 12 that extend from an elongated fuselage 14 that defines a fuselage cavity 16. A spar 18 extends along and is connected to the wings 12. The spar 18 is joined with a coupling 20 situated within the fuselage cavity 16 and is moveable therein. A stabilizer 22 is mounted to the coupling 20 and is movable therewith within the fuselage 14 through a limited range of motion to correspondingly limit motion of the spar 18 with respect to the fuselage 14.

In another aspect, the windsock 10 includes an elongated fuselage 14 including a dorsal surface 24 and a ventral surface defining a fuselage cavity 16. Wings 12 extend from the dorsal surface laterally of the fuselage 14 and include upwardly facing dorsal wing surfaces 28. A dihedral spar 18 extends from within the fuselage along portions of the wings 12 above the dorsal surfaces 28. The spar 18 is mounted to a coupling 20 that is situated within the fuselage cavity 16. A stabilizer 22 is mounted to and extends from the coupling 20 within the fuselage cavity.

In a still further aspect, the wind sock 10 includes an elongated fuselage 14 including a dorsal surface 24 and a ventral surface 26 defining a fuselage cavity 16. Wings extend laterally of the fuselage 14 to opposite sides thereof. Spar members 19 extend laterally of the fuselage 14 from inner ends 34 situated within the fuselage cavity to outward ends 36 adjacent tips 38 of the wings. The spar members 19 s support the wings 12 at a dihedral angle. The spar members 19 are mounted to a coupling 20 that is situated within the fuselage cavity 16. A stabilizer 22 is mounted to and extends from the coupling within the fuselage cavity to a forward end 40. The stabilizer 22 is pivotable with respect to the fuselage 14 between a first position in which the forward end 40 engages the fuselage along the dorsal surface 24 thereof and a second position in which the forward end 40 engages the fuselage along the ventral surface 26 thereof.

DETAILED DESCRIPTION

Reference will now be made in greater detail to the fuselage 14 and wings 12. It is pointed out that the particular configuration of the fuselage 14 and wings 12 may vary from the example illustrated. A goose is indicated by the drawings, but other configurations may also be emulated including other animals or inanimate objects. It is preferable, however that the fuselage take the general configuration illustrated, with the dorsal and ventral surfaces 24, 26 defining the open central cavity 16. It may also be preferable that the fuselage be elongated and taper to a substantially closed forward end 15 from an enlarged open rearward end 17.

It is also pointed out that the term "fuselage" is used broadly to exemplify the central body or torso area of the wind sock. Thus, if the wind sock is made to resemble a goose as exemplified in the drawings, the "fuselage" should be taken to mean the torso or body of the goose.

The fuselage 14 and wings 12 may be formed of flexible plastic film, fabric, or other appropriate light weight but durable synthetic or natural materials such as those commonly used for wind socks or kites. It is also preferable that the selected material be suitable for printing, photo-transfer, or other process by which an image may be affixed or otherwise applied to surfaces of the fuselage and wings.

The wings 12 may be integral with the fuselage or attached to the fuselage by adhesive, sewing, fasteners, fusion, or other appropriate means. In preferred forms, the wings 12 are symmetrical with respect to the fuselage, and extend to opposite lateral sides thereof from the dorsal surface 24. It is also preferable that the wings be flexible to allow emulation of natural wing movement of a flying animal.

Portions along leading wing edges 13 may be provided in such a manner to be bent or folded upward and rearwardly (FIG. 1) over the dorsal wing surfaces 28 in a manner commonly known to encourage aerodynamic lift in wind currents. Thus the leading edges 13 may be formed along the wings in a manner similar to that shown by U.S. Pat. Nos. 6,095,458 or 4,911,384 which are hereby incorporated by reference in the present application.

The spar 18 is preferably comprised of a pair of spar members 19, though it could be formed as a singular member that would extend along both wings 12 and through the fuselage 14. In preferred forms the spar members 19 are joined with the coupling 20 inside the fuselage cavity 16. Alternatively, a singular spar could be passed through the coupling and extend along both wings. In either instance, it is preferable and advantageous that the spar or spar members join the coupling 20 at a substantially central location within the fuselage so the coupling is visually hidden within fuselage and the spar extends with substantially equal lengths on opposite sides of the fuselage 14.

In preferred forms, the spar 18 or spar members 19 may be comprised of flexible rod formed of glass reinforced plastic (fiberglass) or carbon fiber, both of which are desirable materials for light weight, flexibility, resiliency, and strength characteristics. The length of the spar or combined lengths of the spar members should be slightly less than the wing span of the wind sock.

Figure 5:
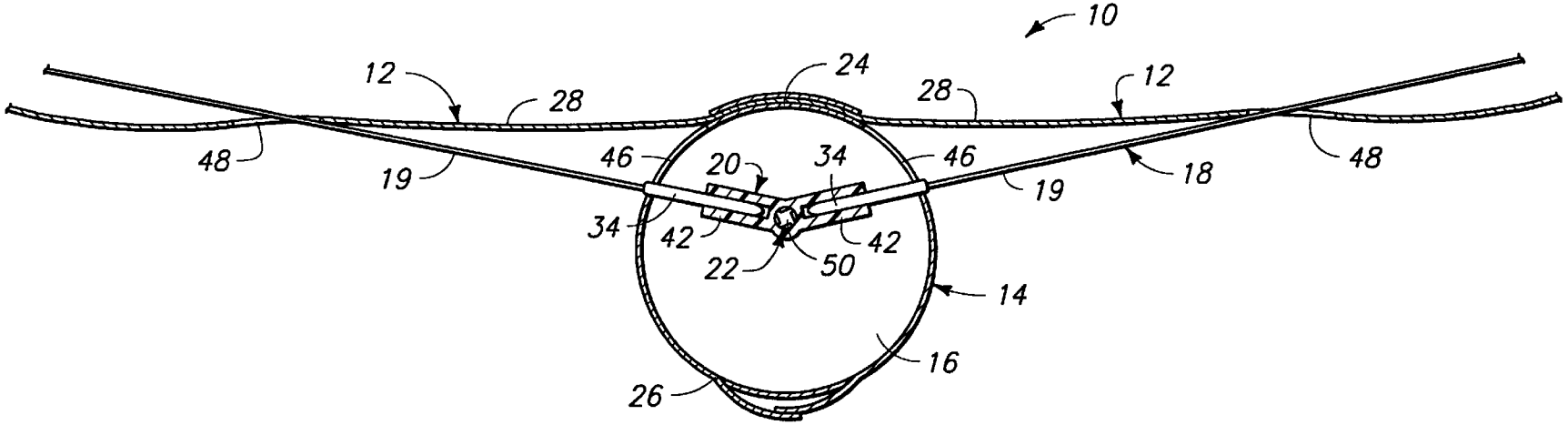
FIG. 5 is a fragmented sectioned view taken along line 5—5 in FIG. 3.
Figure 6:
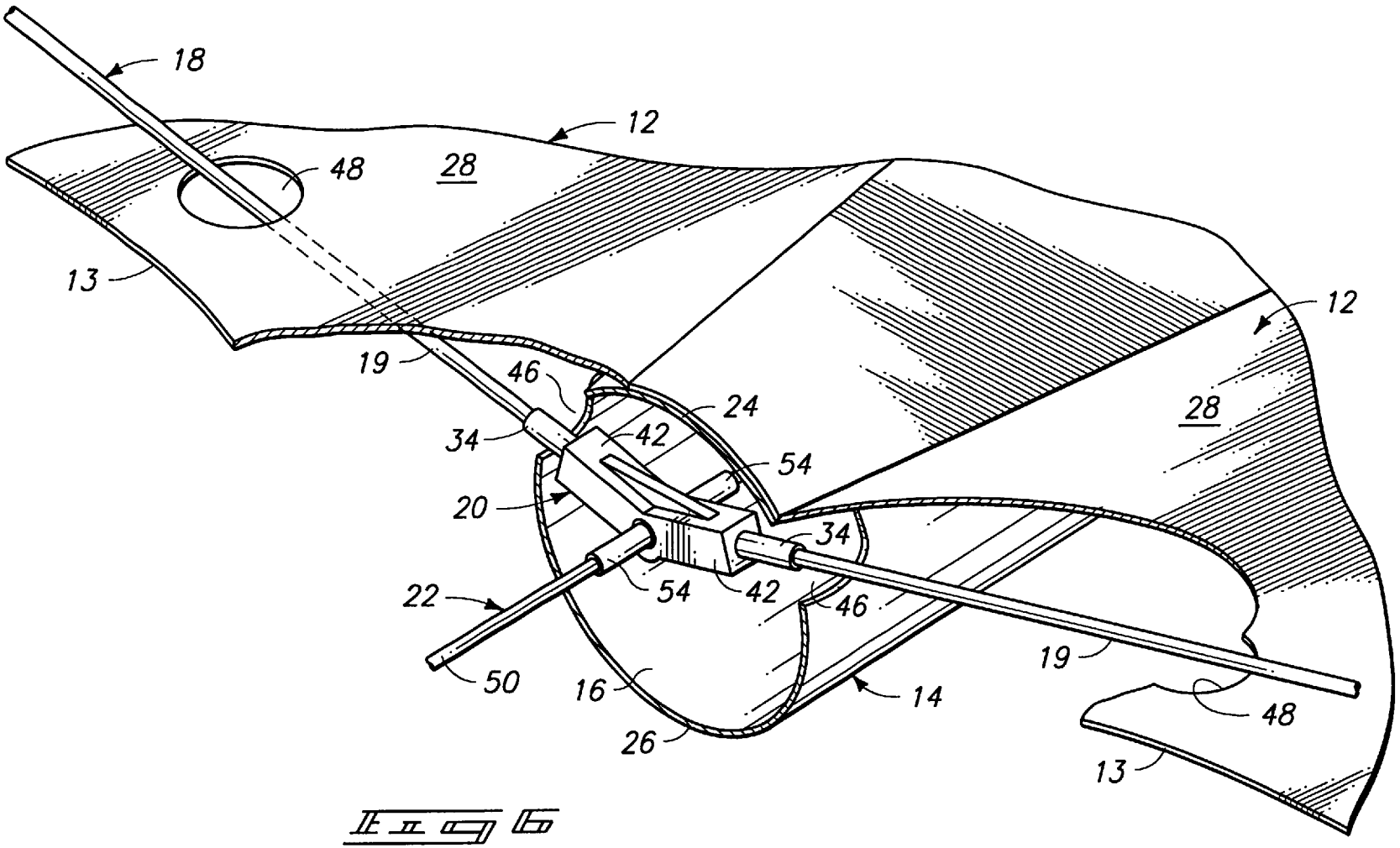
FIG. 6 is a fragmented perspective detail view.
Figure 11:
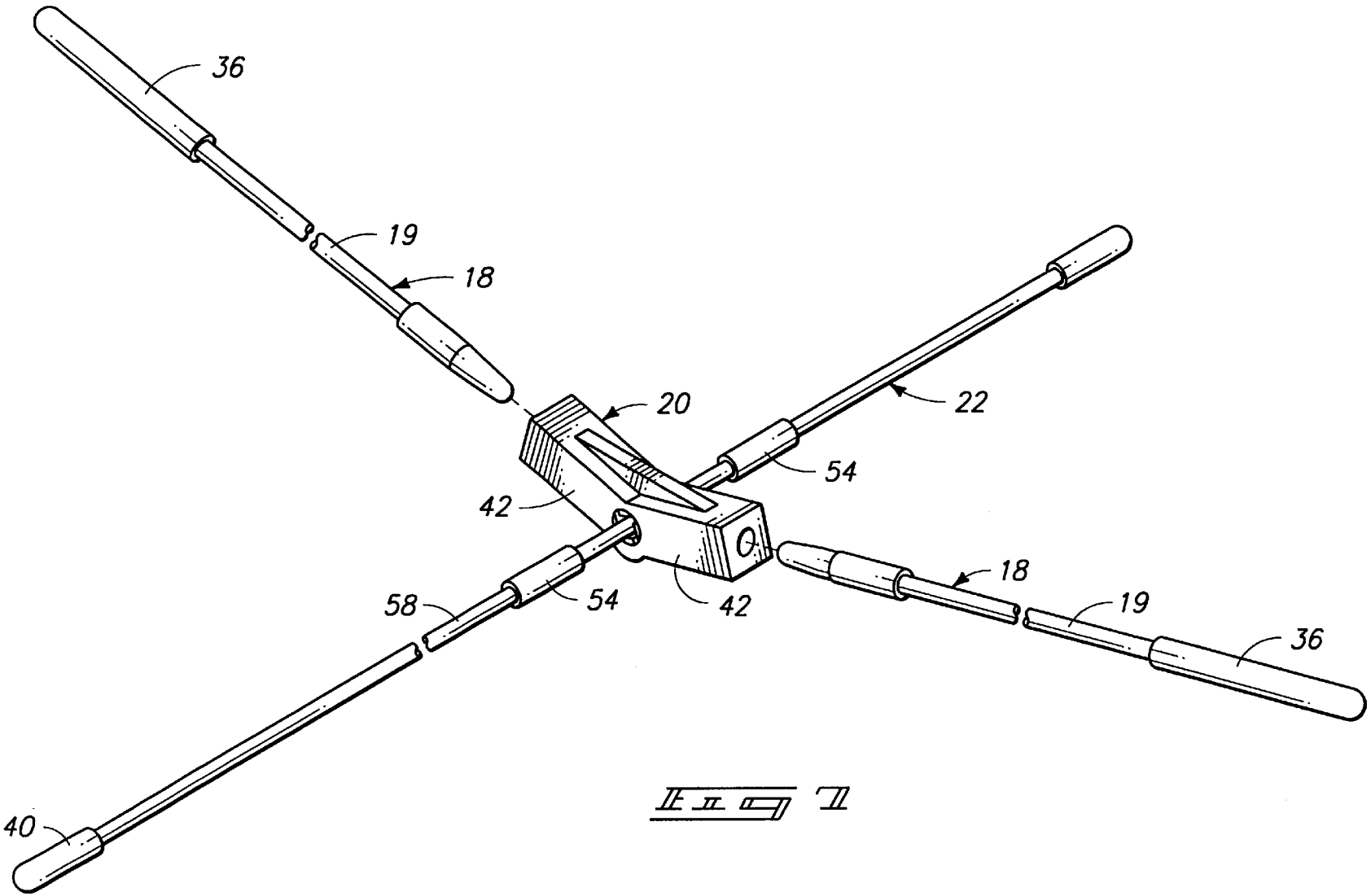

The preferred coupling 20 (FIG. 5) may be formed of injection molded plastic or another material, with opposed sockets 42 for receiving the spar 18. It is preferable that the sockets 42 be angularly oriented to produce the desired dihedral angle along the spar. It is most preferable that the dihedral angle be approximately 10° for each wing and spar member from a horizontal plane. Said another way, the preferred inclusive angle between the spar members on opposite sides of the fuselage may be approximately 160°.

The spar 18, being oriented with the desired dihedral angle will also produce a similar dihedral angle along the wings 12. The flexible wings 12 will be lifted to the desired angles by the upwardly angled spar 18, remote outer ends 36 of which are attached to the wings 12 at locations inwardly adjacent the wing tips 38.

The ends 36 are preferably received by pockets 44 provided adjacent the outward wing ends, and positioned along the dorsal wing surfaces 28. It is also advantageous that the pockets 44 be positioned adjacent to the leading wing edges 13.

Reference will now be made to the interfitting relationship between the spar 18, the fuselage 14, and the wings 12. This relationship has an influence on performance of the wind sock 10 in wind currents, and on the ability, if desired, for the wings to emulate natural wing movement of birds.

The fuselage 14 and wings 12 may be provided with holes 46 and 48 respectively that loosely receive the spar members 19 to permit motion of the fuselage 14 with respect to the spar members and attached wings 12. The holes 46, 48 are oversize with respect to the cross sectional size of the spar to permit such relative movement.

The holes 46, 48, are preferably in lateral alignment across the wings and fuselage, to allow the spar to be fitted loosely but in a supportive manner. In preferred forms, the spar 18 extends laterally from within the fuselage cavity, through the holes 46 and thence beneath the dorsal wing surfaces to the holes 48. The spar extends through the openings 48 in the wings and thence along the dorsal wing surfaces 28 toward wing ends 38. Outer ends 36 of the spar are preferably secured along the dorsal wing surfaces 28 in the pockets 44.

The loose fit between the spar 18, the fuselage 14, and the wings 12 permits relative motion of the respective elements that is controlled within a range of motion by confinement of the spar within the holes 46, 48 and in preferred forms, by the stabilizer 22. In a preferred form, the stabilizer 22 is comprised of an elongated rod 50 extending to the forward end 40 that is pivotable responsive to pivotal motion of the spar with respect to the fuselage 14.

Figure 3:
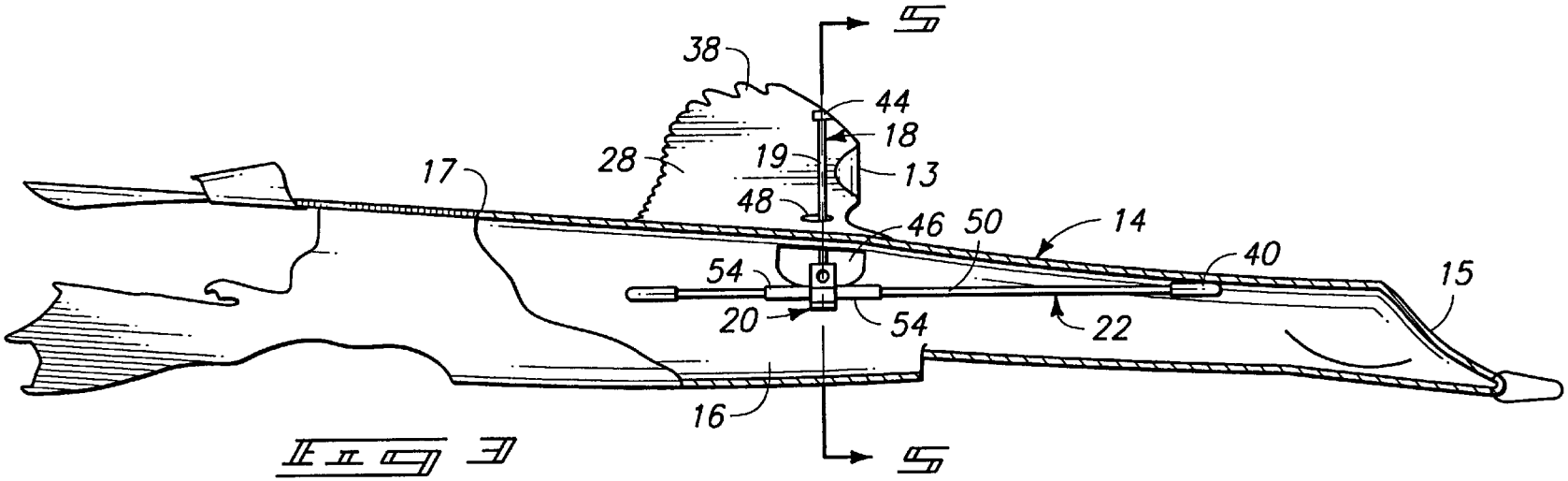
FIG. 3 is a sectional view showing one orientation of the fuselage with respect to the spar.
Figure 4:
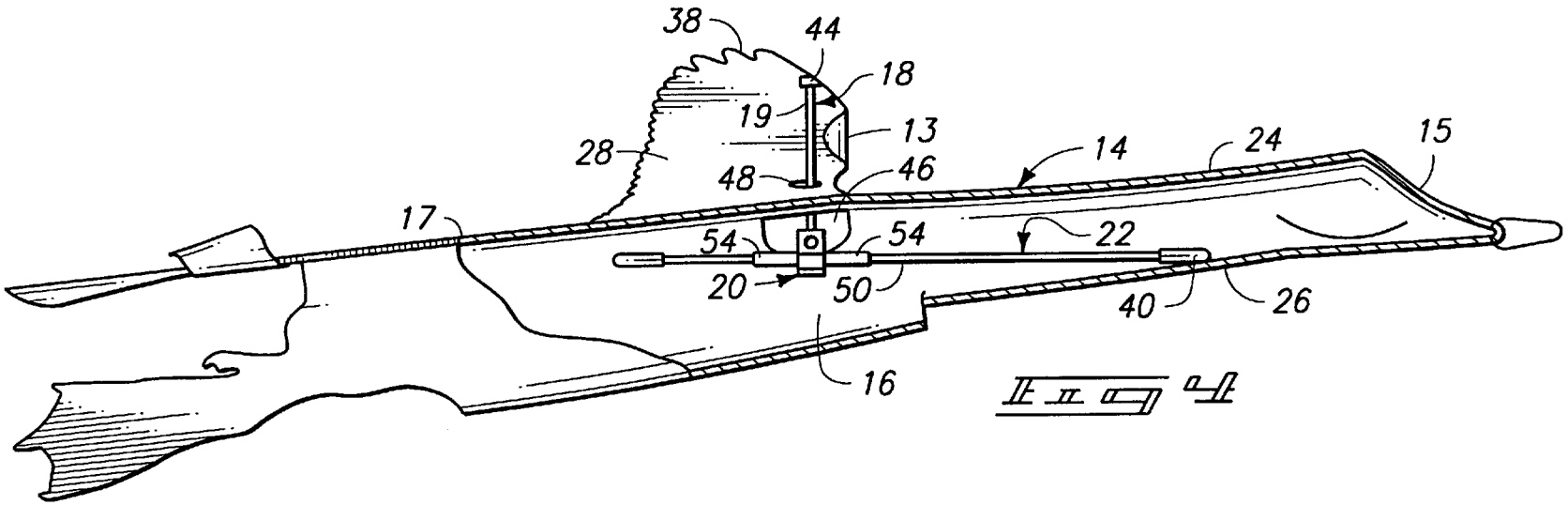
FIG. 4 is a sectional view similar to FIG. 3 only showing a different position of the fuselage.

In preferred forms, the rod 50 is slidably mounted to the coupling 20 and extends therefrom to the forward end 40 which may be situated within the fuselage and movable therein between limits defined by dorsal and a ventral surfaces 24, 26. The range of relative movement is illustrated by FIGS. 3 and 4.

It is preferable that the above range be adjustable to accommodate for wind conditions. This may be done by slidable adjustment of the rod 50 in the coupling 20. If the rod is adjusted forwardly, the range of relative motion is reduced. Conversely, if the rod is adjusted rearwardly, the range is increased.

To accomplish the above adjustments, the stabilizer may be slidably mounted to the coupling through a central longitudinal hole formed therein. The stabilizer rod may be fitted through the hole, and slidable stops 54 may be mounted to the rods for engagement with the coupling. The stops may be provided in the form of flexible sleeves that are sized so that they will move only upon intentional application of force along the rod length. Thus to adjust the rod length projecting forwardly of the coupling, the user must forcibly slide the stops rearwardly along the rod until the desired length of rod is positioned forwardly of the coupling. The stops and then snugged up against the coupling on both sides to secure the rod in the selected position. The stops will then hold the rod in the selected position until further adjustment is desired.

Operation of the present wind sock 10 may now be explained with reference to the exemplary elements described above.

It may be preferable that the present wind sock be distributed in a disassembled form, with the fuselage and wings separate from the spar. If so, assembly may be easily accomplished by threading the spar through the holes 46, 48 and securing the coupling 20 to the spar within the cavity 16. Care is taken to mount the spar such that the resulting configuration resembles FIG. 1 of the drawings; with the greater extent of the spar length positioned over the dorsal wing surface 28 and with the coupling 20 substantially centered within the cavity 16. The dihedral angle that is pre-set by the preferred coupling 20 will also be assumed by the wings 12. Care is taken to assure that the dihedral angle of the spar is oriented such that the wings (when attached to the spar) will angle upwardly from the fuselage.

The stabilizer rod 50 may be fitted through the coupling 20 before or following the above assembly steps. The stops 54 may be slid into position on either side of the coupling 20, with a desired length of the rod projecting forwardly into the cavity 16. This completes assembly.

The wind sock 10 may be secured by an appropriate tether (not shown) to a support such as a post or pole. It is preferable that the tether be connected at the forward end of the fuselage, which in the illustrated example may be the bill of goose shape.

Wind forces acting against the fuselage and wings will cause the windsock to assume a horizontal orientation, with the forward end of the fuselage and leading edges of the wings facing into the wind. The dihedral angle of the wings will help stabilize the windsock, thereby avoiding rolling. Further, the wind acting against resistance of the tether, will cause the fuselage to tip up (FIG. 4) and downwardly (FIG. 3) with respect to the wings. This relative movement occurs due to several factors including the flexibility of the spar, the oversize holes 46, 48; and the changing directional forces of the wind.

Movement of the fuselage 14 with respect to the wings 12 gives the appearance of natural wing movement, even though in reality it is the wings that remain substantially stable while the fuselage moves up and downwardly. The degree of such relative movement may be controlled by selectively extending or retracting the stabilizer rod.

If the stabilizer rod 50 is adjusted forwardly from the coupling 20, the range of movement between the fuselage and wings will be decreased. This may be a desirable adjustment in high wind conditions where the wind forces could otherwise cause undesirable and exaggerated relative fuselage-wing movement. When the desired adjustment is achieved, the stops 54 may be forced against the coupling to hold the stabilizer in the adjusted position.

If the stabilizer rod 50 is adjusted rearwardly in the coupling 20, thereby shortening the length of the stabilizer rod forwardly of the coupling 20, the range of movement between the fuselage and wings will be increased. This may be a desirable adjustment in low wind conditions where low velocity air may not otherwise be sufficient to cause relative fuselage-wing movement. When the desired adjustment is achieved, the stops 54 may be forced against the coupling to hold the stabilizer in the adjusted position.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A windsock, comprising:

an elongated fuselage defining a fuselage cavity;

wings extending from the fuselage at dihedral angles;

a spar extending along and connected to the wings;

wherein the spar is joined with a coupling movably positioned within the fuselage cavity; and a stabilizer mounted to the coupling and movable therewith within the fuselage through a limited range of motion to correspondingly limit motion of the spar with respect to the fuselage.

2. A windsock as defined by claim 1 wherein the fuselage is hollow and includes a dorsal and ventral surface and wherein the range of motion is defined by the dorsal and ventral surfaces.

3. A windsock as defined by claim 1 wherein the wings include dorsal and ventral wing surfaces;

wherein the spar extends from within the fuselage beneath the wings through openings in the wings and along the dorsal surfaces thereof toward wing ends.

4. A windsock as defined by claim 1 wherein the stabilizer is comprised of an elongated rod extending to a forward end that is pivotable responsive to pivotal motion of the spar with respect to the fuselage.

5. A windsock as defined by claim 1 wherein the stabilizer is comprised of an elongated rod slidably mounted to the coupling.

6. A windsock as defined by claim 1 wherein the stabilizer is comprised of an elongated rod slidably mounted to the coupling and extending to a forward end situated within the fuselage and movable therein between limits defined by a dorsal and a ventral surface of the fuselage.

7. A windsock as defined by claim 1 wherein the fuselage includes a dorsal and a ventral surface and wherein the stabilizer is comprised of an elongated rod extending to a forward end that is pivotable responsive to pivotal motion of the spar, between limits defined by the dorsal and ventral surfaces.

8. A windsock as defined by claim 1 wherein the fuselage and wings include openings loosely receiving the spar.

9. A windsock, comprising:

an elongated fuselage including a dorsal and a ventral surface defining a fuselage cavity;

wings extending from the dorsal surface laterally of the fuselage and including upwardly facing dorsal wing surfaces oriented at dihedral angles;

a dihedral spar extending from within the fuselage to portions of the wings above the dorsal wing surfaces;

wherein the dihedral spar is mounted to a coupling situated within the fuselage cavity; and a stabilizer mounted to and extending from the coupling within the fuselage cavity.

10. A windsock as defined by claim 9 wherein the spar extends beneath the dorsal wing surfaces and thence through openings in the wings and thence along the dorsal wing surfaces and toward wing ends.

11. A windsock as defined by claim 9 wherein the stabilizer is comprised of an elongated rod extending to a forward end that is pivotable responsive to relative pivotal motion of the fuselage with respect to the spar.

12. A windsock as defined by claim 9 wherein the spar is formed of at least one flexible elongated rod releasably mounted to the coupling.

13. A windsock as defined by claim 9 wherein the spar is comprised of flexible elongated rods releasably mounted to the coupling, and wherein the stabilizer is comprised of an elongated rod extending from the coupling to a forward end that is pivotable responsive to relative pivotal motion of the fuselage with respect to the spar.

14. A windsock as defined by claim 9 wherein the stabilizer is comprised of an elongated rod slidably mounted to the coupling.

15. A windsock as defined by claim 9 wherein the stabilizer is comprised of an elongated rod slidably mounted to the coupling and extending to a forward end situated within the fuselage and movable therein between limits defined by the dorsal and a ventral surfaces.

16. A wind sock, comprising:

an elongated fuselage including a dorsal surface and a ventral surface defining a fuselage cavity;

wings extending laterally of the fuselage to opposite sides thereof;

spar members extending laterally of the fuselage from a point within the fuselage cavity to points adjacent tips of the wings, supporting the wings at a dihedral angle;

wherein the spar members are mounted to a coupling situated within the fuselage cavity;

a stabilizer mounted to and extending from the coupling within the fuselage cavity to a forward end; and wherein the stabilizer is pivotable with respect to the fuselage between a first position in which the forward end engages the fuselage along the dorsal surface thereof and a second position in which the forward end engages the fuselage along the ventral surface thereof.

17. A windsock as defined by claim 16 wherein the spar members each form a dihedral angle of about 10° from a horizontal plane.

18. A windsock as defined by claim 16 wherein the fuselage and wings include holes that loosely receive the spar members to permit motion of the spar members.

19. A windsock as defined by claim 16 wherein the spar members are formed of elongated flexible rods that extend from the coupling through enlarged holes in the fuselage, thence along the ventral surfaces of the wings, thence through enlarged holes in the wings, and thence along the dorsal surfaces of the wings to ends mounted to the wings adjacent outward wing ends.

20. A windsock as defined by claim 16 wherein the spars and stabilizer are formed of elongated flexible rods releasably mounted to the coupling, and wherein the stabilizer is slidably mounted to the coupling between slidably adjustable stops.

* * * * *